US006711869B2

(12) United States Patent
Tychsen

(10) Patent No.: US 6,711,869 B2
(45) Date of Patent: Mar. 30, 2004

(54) PROCESS OF LAYING FLOORBOARDS

(75) Inventor: Detlef Tychsen, Lohne (DE)

(73) Assignee: Kronotec AG, Luzern (CH)

( * ) Notice: Subject to any disclaimer, the term of this patent is extended or adjusted under 35 U.S.C. 154(b) by 0 days.

(21) Appl. No.: 09/893,787

(22) Filed: Jun. 29, 2001

(65) Prior Publication Data

US 2002/0046542 A1 Apr. 25, 2002

(30) Foreign Application Priority Data

Jun. 30, 2000 (DE) ..... 001 13 843

(51) Int. Cl.[7] ..... E04B 1/00; E04G 21/00

(52) U.S. Cl. ..... 52/747.11; 52/747.1; 52/749.11; 52/592.2; 52/392; 156/72; 156/304.5; 428/40.1; 428/91

(58) Field of Search ..... 52/748.1, 747.1, 52/747.11, 403.1, 480, 506.05, 592.2, 591.4, 749.11, 390, DIG. 1, 392; 428/90, 91, 40.1; 156/71, 72, 304.5

(56) References Cited

U.S. PATENT DOCUMENTS

| | | | | | |
|---|---|---|---|---|---|
| 2,257,048 | A | * | 9/1941 | Fulbright | 52/582.1 |
| 2,283,135 | A | * | 5/1942 | Bruce | 52/582.1 |
| 4,095,388 | A | * | 6/1978 | Sinkow | 52/747 |
| 4,503,654 | A | * | 3/1985 | Cosentino | 428/192 |
| 5,860,267 | A | | 1/1999 | Pervan | |
| 5,941,047 | A | * | 8/1999 | Johansson | 52/390 |
| 6,000,178 | A | * | 12/1999 | Goodings | 52/235 |
| 6,023,907 | A | | 2/2000 | Pervan | |
| 6,101,778 | A | * | 8/2000 | M.ang.rtensson | 52/582.1 |
| 6,119,423 | A | * | 9/2000 | Costantino | 52/313 |
| 6,216,410 | B1 | * | 4/2001 | Haberman | 403/381 |
| 6,237,295 | B1 | * | 5/2001 | Ballard | 52/391 |
| 6,363,677 | B1 | * | 4/2002 | Chen et al. | 52/384 |
| 6,397,547 | B1 | * | 6/2002 | M.ang.rtensson | 52/582.1 |
| 6,401,425 | B1 | * | 6/2002 | Frame | 52/518 |

FOREIGN PATENT DOCUMENTS

| | | | | |
|---|---|---|---|---|
| DE | 200 02 413 U1 | | 5/2000 | |
| FR | 2667639 | * | 11/1991 | E04F/15/02 |
| JP | 5-25878 | * | 7/1991 | E04B/7/02 |

* cited by examiner

*Primary Examiner*—Carl D. Friedman
*Assistant Examiner*—Chi Q. Nguyen
(74) *Attorney, Agent, or Firm*—McGuireWoods LLP

(57) ABSTRACT

A process is proposed for laying and mechanically jointing floorboards provided with tongue and groove engagements on all sides for horizontal attachment. The process involves a) jointing of a number of boards and making them engage on their transverse sides n order to lay a first row on the floor of a room, b) jointing of a first board for a second row and making it engage with one or two boards in the first row using the tongue and groove joint on the longitudinal side for the purpose of starting a second row, c) pushing the tongue (or groove) of a second board into the groove (or tongue) on the transverse side of the first board in the second row, with movement from the longitudinal side towards the boards in the first row, and d) making the second board engage with one or two boards in the first row.

5 Claims, 1 Drawing Sheet

PROCESS OF LAYING FLOORBOARDS

This invention refers to a process of laying and mechanically jointing floorboards which have a tongue one of their longitudinal and transverse sides and a groove matching the tongue on their opposite longitudinal and transverse sides, the tongue and groove being designed to permit boards to engage with one another horizontally.

A number of floorboard-laying procedures are described in U.S. Pat. Nos. 5,860,267 and 6,023,907. In the known procedures, the boards are placed in an initial row and at least one board is placed in the second row and is jointed on its longitudinal side to boards in the first row. A new board is partially jointed on its transverse side to the board in the second row. The new board is placed flat on the floor. The board from the second row and the new board are then lifted together and tilted against the first row. The new board is then shifted relatively to the board from the second row until it engages on its longitudinal side with boards in the first row.

The second and the new board are then swung down again to form a joint with the second and the first row. In a procedure which is also described, the new board is first shifted horizontally towards the first row until the boards engage on their longitudinal edges and are then shifted relatively to the first row towards the transverse side of the board in the second row until the boards engage.

The first procedure described is quite complicated to execute because the person laying the floor must use one hand to swing the boards up and use the other to push in the new board which is tilted. If the new board is twisted, there is a risk of the tongue splitting off or of the groove breaking apart. The mere deadweight of a board can cause damage to the tongue and groove joint when the boards are lifted from the floor. This means, essentially, that this laying procedure can only be carried out by two persons.

In order to permit a new board to be first jointed on its longitudinal side with the preceding row of boards and then shifted longitudinally on to the board in the second row, the tongue and groove interface has, according to U.S. Pat. No. 6,023,907, a tolerance $\Delta$ at the joint. Providing such a tolerance at the joint has, however, the disadvantage that the boards can be shifted not only along the line of the joint but also transversely to it. In consequence, the attachment between adjoining boards is not moisture-proof and moisture can penetrate. This is a particular problem in the case of MDF (medium density fibreboard) or HDF (high density fibreboard) laminated boards because there is a risk of the core swelling because of moisture penetration, which can ruin a floor.

It is suggested in the cited documents that this risk should be eliminated by inserting a moisture-proof substance between the joints, such as silicon or a rubber strip. This step of course complicates the floor laying procedure. In addition, ensuring that the joints stay really moisture-proof requires an exact method which cannot be expected when "snap-on interfaces" of this kind are used by home handymen.

For this reason "snap-on interfaces", that is to say, boards made so that two attached boards engage or lock together at the joint by means of a tongue and groove, are designed to have a prestressing instead of a tolerance at the interlock, which ensures that the boards are so jointed that they fit tightly together, especially on the upper side. Two boards longitudinally jointed together with pre-stressing and measuring several metres in length can, because of friction at the joint, be shifted in relation to one another only with a considerable expenditure of energy. In order to joint the newly inserted board with the transverse side of the board already positioned in the second row, the person laying the floor must generally use force and drive the new board in the desired direction by means of hammer blows. A careless hammer blow may not only ruin the transverse side of the new board, made fragile by the interface, but also cause damage to the upper edge of the joint which may not be noticed. If, as a result of such damage to the plane of separation, the boards can no longer be laid tightly, moisture can subsequently penetrate and ruin the floor as described above.

German Patent publication 200 02 413 U1 provides a description of boards with snap-on interfaces, laid in such a manner that they are first pushed into one another on their longitudinal side and the newly laid board, already jointed longitudinally with a board previously laid, is shifted longitudinally by hammer blows on its transverse side until its opposed front side engages with the front side of a board previously laid. The laying procedure described in the document does not permit the person laying the floor to joint the narrow sides first and then hammer the board on its longitudinal side so as to drive it far enough transversely for it to engage on its longitudinal side with the row of boards previously laid.

SUMMARY OF INVENTION

In view of this problem, it is proposed to develop a floor-laying procedure which even inexperienced persons can use simply and quickly to lay mechanically interlocking boards ("snap-on interfaces") so constructed that they are subject to pre-stressing at the joint.

According to one aspect of the invention, there is provided a process in which:

(a) first, a number of boards are laid on the floor to form a first row by jointing them and making them engage on their transverse side, (b) a first board of a second row is then jointed and made to engage at the beginning of a second row on its longitudinal side with one or two boards in the first row by means of the tongue and groove joint, (c) starting from the longitudinal side, the tongue of a new board is then inserted into the groove on the transverse side of the first board in the second row and the new board is shifted towards the first row until it engages with one or two boards in the first row. The procedure is repeated until the floor is complete or substantially complete.

The boards can also be laid in such a way that a new board in a second row is not inserted using its tongue into the groove of a board previously laid but is pushed using its groove on to the tongue of a board previously laid.

The procedure to which the intention refers requires the faces inserted into one another to be shifted in relation to one another only over a short distance, thus minimising friction (the surface subject to friction increases linearly as the "threading" of the tongue and groove proceeds). The force required to overcome the increase in friction can be exerted by hand without the aid of a tool, so that the risk of damaging edges is permanently eliminated.

DESCRIPTION OF DRAWINGS

The process of the invention is described in more detail below with reference to the accompanying drawings, in which.

DETAILED DESCRIPTION OF PREFERRED EMBODIMENT

Figure 1:
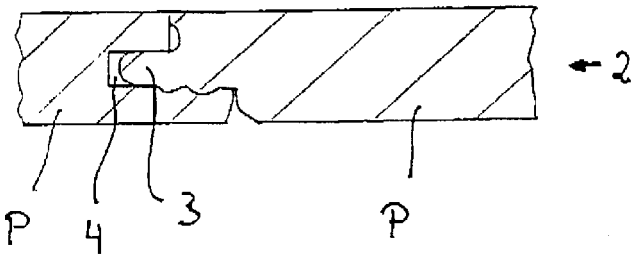
FIG. 1 is a schematic illustration of two floorboards jointed together, in cross-section.
Figure 2:
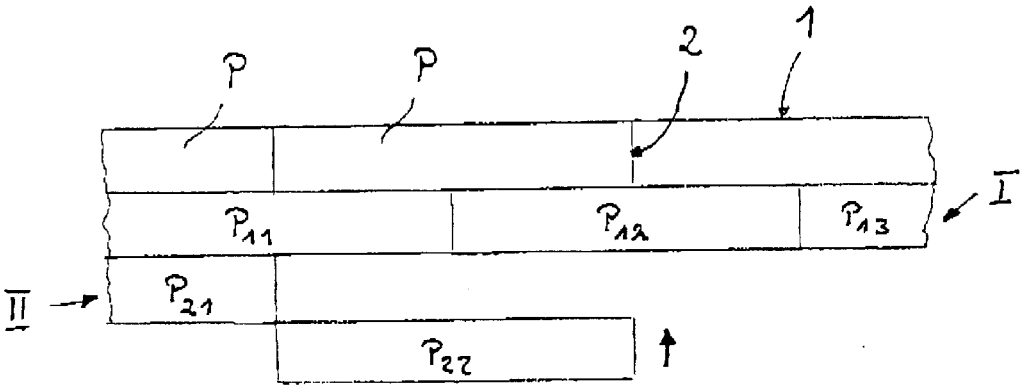
FIG. 2 is a plan of partially laid flooring according to one form of the present invention.

As shown in the accompanying drawings, the boards P have on their longitudinal sides 1 and their transverse sides 2, tongues 3 and grooves 4 in matching opposite positions. On the underside of the tongue 3 there are projections, not described here in further detail, which can engage in recesses, also not described here in further detail, on the lower lip of the groove 4. The boards P can be locked together by pushing the tongue 3 into the groove 4. The constructional details of the boards will not be further explained. In this regard, reference may be made to German patent No. 198 21 200.

For the purpose of laying the floor, the first step is to make a first row I of boards $P_{11}, P_{12}, P_{13}, \ldots P_{1n}$ from wall to wall of a room, these boards $P_{11}, \ldots P_{1n}$ being jointed on their transverse sides. In a following row II, a first board $P_{21}$ is jointed on its longitudinal side with the first board $P_{11}$ in the previously laid first row I. A board $P_{22}$, which is to be laid next, is then fitted, starting from its longitudinal side, by its tongue 3 into the groove 4 of the board $P_{21}$ and is shifted towards the first row I, with the tongue 3 sliding in the groove 4 until the board $P_{22}$ on its longitudinal side engages with the boards $P_{11}$ and $P_{12}$. As board $P_{22}$ is shifted, its tongue 3 passes over a longer distance into the groove of board $P_{21}$ until the two boards $P_{21}$, $P_{22}$ are completely jointed together along their transverse side 2. It is also possible to lay a floor in accordance with this procedure by mounting board $P_{22}$, using its groove 4, on the tongue 3 of the board $P_{21}$.

What is claimed is:

1. A process of laying and mechanically jointing floorboards which have, on one longitudinal side and one transverse side, a tongue and, one an opposite longitudinal side and an transverse side, a groove matching the tongue, the tongues and the grooves being designed so that boards inserted into one another engage horizontally, the process comprising:

a) jointing a plurality of boards and making them engage on their transverse sides in order to lay a first row on a floor of a room, b) jointing a first board of a second row and making it engage with one or two boards in the first row using the tongue and groove joint on the longitudinal side for the purpose of starting a second row, c) pushing a tongue of a second board into a groove on the traverse side of the first board in the second row, the movement being from the longitudinal side towards the boards in the first row; and d) making the second board engage with one or two boards in the first row.

2. A process according to claim 1, wherein steps (b), (c) and (d) are repeated until the floor is complete or substantially complete.

3. A process of laying and mechanically jointing floorboards which have a tongue on one longitudinal side and one transverse side and a groove matching the tongue on the opposite longitudinal side and transverse side, the tongue and the groove being designed so that boards inserted into one another engage horizontally, the process comprising:

a) jointing a plurality of boards and making them engage on their transverse sides in order to lay a first row on a floor of a room, b) jointing a first board of a second row and making it engage with one or two boards in the first row by means of the tongue and groove joint on the longitudinal side for the purpose of starting a second row, c) pushing the groove of a second board on to the tongue on the traverse side of the first board in the second row, the movement being from the longitudinal side towards the boards in the first row; and d) making the second board engage with one or two boards in the first row.

4. A process according to claim 3, wherein steps (b), (c) and (d) are repeated until the floor is complete or substantially complete.

5. A process of laying and mechanically jointing floorboards which have a tongue on one longitudinal side and one transverse side and a groove matching the tongue on the opposite longitudinal side and transverse side, the tongue and the groove having a corresponding locking projection and indentation and being designed so that boards inserted into one another engage horizontally, the process comprising:

e) jointing a plurality of boards and making them engage on their transverse sides in order to lay a first row on the floor;

f) jointing a first board of a second row and making it engage with one or two boards in the first row by means of the tongue and groove joint on the longitudinal side for purposes of starting a second row;

g) aligning a corner of the first board with a corner of a second board for the second row on the transverse sides;

h) sliding, toward the longitudinal side of the board in the first row, the groove or tongue of the second board on the transverse side into the respective tongue or groove on the transverse side of the first board in the second row, the tongue and respective groove remain engaged during the sliding; and i) jointing the second board with one or two of boards in the first row on the longitudinal side.

* * * * *

UNITED STATES PATENT AND TRADEMARK OFFICE

CERTIFICATE OF CORRECTION

PATENT NO. : 6,711,869 B2
DATED : March 30, 2004
INVENTOR(S) : Detlef Tychsen

It is certified that error appears in the above-identified patent and that said Letters Patent is hereby corrected as shown below:

Column 4,
Line 36, change “e)” to -- a ) --.
Line 39, change “f)” to -- b) --.
Line 43, change “g)” to -- c) --.
Line 46, change “h)” to -- d) --.
Line 52, change “i)” to -- e) --.

Signed and Sealed this

First Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,711,869 B2
DATED : March 30, 2004
INVENTOR(S) : Detlef Tychsen

It is certified that error appears in the above-identified patent and that said Letters Patent is hereby corrected as shown below:

Title page,
Item [30], Foreign Application Priority Data, delete "DE...001 13 843" and insert -- EP 00113843.7 --.

Signed and Sealed this

Twenty-fifth Day of January, 2005

JON W. DUDAS
*Director of the United States Patent and Trademark Office*